US012290713B2

(12) United States Patent
Wang

(10) Patent No.: US 12,290,713 B2
(45) Date of Patent: May 6, 2025

(54) ROTARY DUMBBELL

(71) Applicant: Hao's Fitness Equipment (Shanghai) Co., Ltd. Trading Ltd., Shanghai (CN)

(72) Inventor: Lihui Wang, Fujian (CN)

(73) Assignee: Hao's Fitness Equipment (Shanghai) Co., Ltd. Trading Ltd., Shanghai (CN)

( * ) Notice: Subject to any disclaimer, the term of this patent is extended or adjusted under 35 U.S.C. 154(b) by 360 days.

(21) Appl. No.: 17/980,305

(22) Filed: Nov. 3, 2022

(65) Prior Publication Data

US 2023/0052772 A1 Feb. 16, 2023

Related U.S. Application Data

(63) Continuation of application No. PCT/CN2020/105140, filed on Jul. 28, 2020.

(30) Foreign Application Priority Data

Jul. 20, 2020 (CN) ..... 202021426012.8

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01)

(58) Field of Classification Search
CPC ..... A63B 21/075; A63B 21/0726
See application file for complete search history.

(56) References Cited

U.S. PATENT DOCUMENTS

2019/0168059 A1 6/2019 Svenberg

FOREIGN PATENT DOCUMENTS

| | | | | |
|---|---|---|---|---|
| CN | 201558453 U | * | 8/2010 | |
| CN | 105102078 A | | 11/2015 | |
| CN | 205127273 U | | 4/2016 | |
| CN | 109621294 A | | 4/2019 | |
| CN | 209771198 U | | 12/2019 | |
| CN | 111450475 A | | 7/2020 | |
| CN | 212282678 U | | 1/2021 | |
| WO | WO-2021232966 A1 | * | 11/2021 | ..... A63B 21/075 |

OTHER PUBLICATIONS

International Search Report of PCT/CN2020/105140.
Written Opinion of PCT/CN2020/105140.

* cited by examiner

*Primary Examiner* — Sundhara M Ganesan
*Assistant Examiner* — Jacqueline N L Loberiza

(57) ABSTRACT

The present disclosure provides a rotary dumbbell. The rotary dumbbell includes a handle part, a base part, weight parts arranged at two ends of the handle part respectively, and a transmission self-locking mechanism and a driven mechanism which are arranged at the two ends of the handle part respectively and abut against the weight parts respectively. The transmission self-locking mechanism includes a transmission assembly and a self-locking ring; the transmission assembly includes a planetary gear transmission mechanism, a first output screw, a long nut and a first screw spline. The driven mechanism includes a decorative ring, a second handle flange, a second transition flange and a driven assembly. The driven assembly includes a second output screw and a second screw spline; the weight parts are provided with weight plates with a dovetail groove structure; and the base part is provided with an unlocking thimble.

10 Claims, 10 Drawing Sheets

ROTARY DUMBBELL

CROSS-REFERENCE TO RELATED APPLICATIONS

This application is a bypass continuation application of PCT application no.: PCT/CN2020/105140. This application claims priorities from PCT Application PCT/CN2020/105140, filed Jul. 28, 2020, and from Chinese Application 202021426012.8, filed Jul. 20, 2020, the contents of which are incorporated herein in the entirety by reference.

TECHNICAL FIELD

The present disclosure relates to the technical field of fitness equipment, and in particular to a rotary dumbbell.

BACKGROUND

As a simple device for enhancing muscle strength training, dumbbells can be used for muscle strength training and compound muscle action training A dumbbell mainly includes a dumbbell rod and a dumbbell head, the dumbbell rod is a multi-diameter shaft, one end of the dumbbell head abuts against a shoulder of the dumbbell rod, and the other end is held down by a hold-down nut. To adjust dumbbell weights, the hold-down nut needs to be screwed manually to manually disassemble or assemble weight plates, which is troublesome to operate and inconvenient to use. Moreover, most of traditional weight plates use notched weights, so that a user can only hold in one direction while training, otherwise, there will be a feeling of top-heavy, affecting user experience. In addition, hooks and weight plates are separated, therefore, defects of easy falling off and separation and short service life are present.

The patent for invention with publication number CN105194835A discloses a novel dumbbell. The novel dumbbell includes a dumbbell rod, a dumbbell head and a locking nut, a through hole is formed in the dumbbell head, threaded rod sections are arranged at two ends of the dumbbell rod, the locking nut is in threaded connection with the threaded rod sections, and the dumbbell head includes a big dumbbell block and a small dumbbell block. A groove having a shape matched with that of the small dumbbell block is formed in the big dumbbell block. A pressing block is further arranged between the locking nut and the dumbbell head.

The present disclosure with publication number CN205127273U provides an adjustable dumbbell weight adjusting rod. An extension length of a crossbar is adjusted by screwing a dumbbell rod, so as to adjust a quantity of weight discs to be hooked to adjust weights, and use a more convenient adjustable dumbbell weight adjusting rod. The technical solution used includes a dumbbell rod and connectors arranged at two ends of the dumbbell rod, a crossbar for hooking weight discs is arranged in the dumbbell rod, and the dumbbell rod is connected to the crossbar through the connectors for driving the crossbar to move from side to side.

However, the above-mentioned dumbbells have defects that weights cannot be added or removed automatically, and potential safety hazards during use cannot be eliminated.

SUMMARY

An objective of the present disclosure is to provide a rotary dumbbell to overcome deficiencies in the prior art.

To achieve the objective of the present disclosure, the present disclosure provides a rotary dumbbell, including a handle part and weight parts arranged at two ends of the handle part respectively. The rotary dumbbell further includes a transmission self-locking mechanism and a driven mechanism which are arranged at the two ends of the handle part respectively and abut against the two weight parts respectively;

the transmission self-locking mechanism includes a transmission assembly; the transmission assembly includes a planetary gear transmission mechanism, a first output screw, a long nut in matched connection with the first output screw, and a first screw spline splined to the first output screw; the long nut is rotatably connected to the planetary gear transmission mechanism to enable the long nut to rotate under the drive of the planetary gear transmission mechanism, so that the first output screw moves axially through the first screw spline.

Preferably, the planetary gear transmission mechanism includes a sun gear and a plurality of planetary gears symmetrically arranged outside the sun gear; a large internal gear is arranged outside the planetary gears; the large internal gear is meshed with the planetary gears, and the long nut is sleeved at a middle position of the sun gear.

Preferably, the transmission self-locking mechanism further includes a self-locking ring; the self-locking ring is provided with a self-locking hole, a self-locking pin matched with the self-locking hole and a plurality of self-locking posts in matched connection with central through holes of the planetary gears; and the self-locking ring is nested on the large internal gear.

Preferably, the transmission self-locking mechanism further includes a first handle flange arranged between the transmission assembly and the handle part and a first transition flange arranged between the transmission assembly and the weight parts.

Preferably, the driven mechanism includes a decorative ring, a second handle flange and a second transition flange which are arranged at two ends of the decorative ring respectively, and a driven assembly.

Preferably, the driven assembly includes a second output screw and a second screw spline splined to the second output screw; and the second output screw is in matched connection with the long nut.

Preferably, the weight parts include a first weight plate, a plurality of middle weight plates and a last weight plate each; a first dovetail groove and a first embedded part are arranged oppositely at one end of the first weight plate and the last weight plate, and two sides of the middle weight plates are provided with a second dovetail groove and a second embedded part opposite to each other; and positions of the second dovetail groove and the second embedded part on the two sides are corresponding to each other.

Preferably, the rotary dumbbell further includes a base part, the base part includes a base, baffles arranged at two ends of the base respectively, a reinforcing member arranged on the base, and a support seat arranged in the middle of the base, and an unlocking thimble opposite to the self-locking pin is arranged on the support seat.

Preferably, the reinforcing member is arranged in a length direction of the base, and is made of a stainless steel.

Preferably, the weight parts are sleeved on the first output screw and the second output screw respectively; and the first output screw and the second output screw move axially under the rotary drive of the long nut.

Preferably, the base part is configured to prevent the weight parts from moving axially and allow the weight parts to move radially corresponding to the base part.

Compared with the prior art, the present disclosure has the following beneficial effects:

1. The rotary dumbbell provided in the present disclosure is designed with a transmission mechanism with a star gear adjustment structure, so that a function of automatically adding and removing weight plates in a rotary mode can be achieved. Compared with traditional dumbbells, convenience of using the rotary dumbbell is significantly improved. The function of adding and removing the weight plates can be achieved by rotating and adjusting a gear without disassembling the weight plates during use. Specific operation is as follows: a large internal gear is adjusted and rotated to drive planetary gears to drive a long nut which is sleeved with a sun gear to rotate, an output screw is driven by a long nut to move linearly through a screw spline for propulsion, thereby achieving the function of automatically adding and removing the weight plates in a rotary mode.
2. According to the rotary dumbbell provided in the present disclosure, a dovetail groove structure is designed for connection between weight plates, therefore, the weight plates are intact without notch, and eccentricity is not produced during exercise, so that experience is better, there is no feeling of weightlessness when doing an arc movement, and the weight plates do not make a sound because of swaying from side to side and collision. In addition, the dovetail groove structure can also function as a hook, so that the weight plates are integrated with the hook, and compared with a traditional design that a dumbbell is separated from a hook, the integrated design provided in the present disclosure has advantages of long service life and no potential safety hazard of falling off.
3. According to the rotary dumbbell provided in the present disclosure, a self-locking structure is further designed on the structural basis of a planetary gear transmission mechanism. Through the control of a self-locking ring and a self-locking pin, when the dumbbell is placed on a base, an unlocking thimble on the base pushes up the self-locking pin to achieve an unlocking function, and then the large internal gear is rotated to add and remove weight plates. When the dumbbell leaves the base, the self-locking pin is pushed out and reset by a spring to achieve a self-locking function, and the large internal gear is locked and cannot rotate, so as to play a protective role and ensure safety.
4. According to the rotary dumbbell provided in the present disclosure, the weight plates are directly locked on the handle without transition component between the dumbbell handle and the weight plates, so that the dumbbell is safer to use.
5. According to the rotary dumbbell provided in the present disclosure, functions of automatic weight adjustment in a rotary mode and safe self-locking protection without manual touch are achieved through propulsion of output screws of the planetary gear transmission mechanism, cooperation between a self-locking device and an unlocking thimble on the base, and design of weight plates with a dovetail groove structure, so as to improve user experience and prolong service life of hooks for the dumbbell.

REFERENCE NUMBER IN THE FIGURES

100. rotary dumbbell; 10. handle part; 20. weight parts; 30. transmission self-locking mechanism; 40. driven mechanism; 50. base part;

21. first weight plate; 22. middle weight plates; 23. last weight plate; 24. first dovetail groove; 25. first embedded part; 26. second dovetail groove; 27. second embedded part;

31. first handle flange; 32. self-locking ring; 321. self-locking hole; 322. self-locking pin; 323. self-locking posts; 34. first transition flange; 35. transmission assembly; 351. planetary gear transmission mechanism; 352. first output screw; 353. long nut; 354. first screw spline; 3511. sun gear; 3512. planetary gears; 3513. large internal gear;

41. second handle flange; 42. decorative ring; 43. second transition flange; 44. driven assembly; 441. second output screw; 442. second screw spline;

51. base; 52. baffles; 53. reinforcing member; 54. support seat; 55. unlocking thimble.

DETAILED DESCRIPTION OF THE PREFERRED EMBODIMENTS

The following clearly and completely describes the technical solutions in the embodiments of the present disclosure with reference to the accompanying drawings. Obviously, the described embodiments are merely some but not all of embodiments of the present disclosure. Based on the embodiments of the present disclosure, all other embodiments obtained by those of ordinary skill in the art without creative efforts should fall within the scope set forth in the present disclosure.

Figure 1:
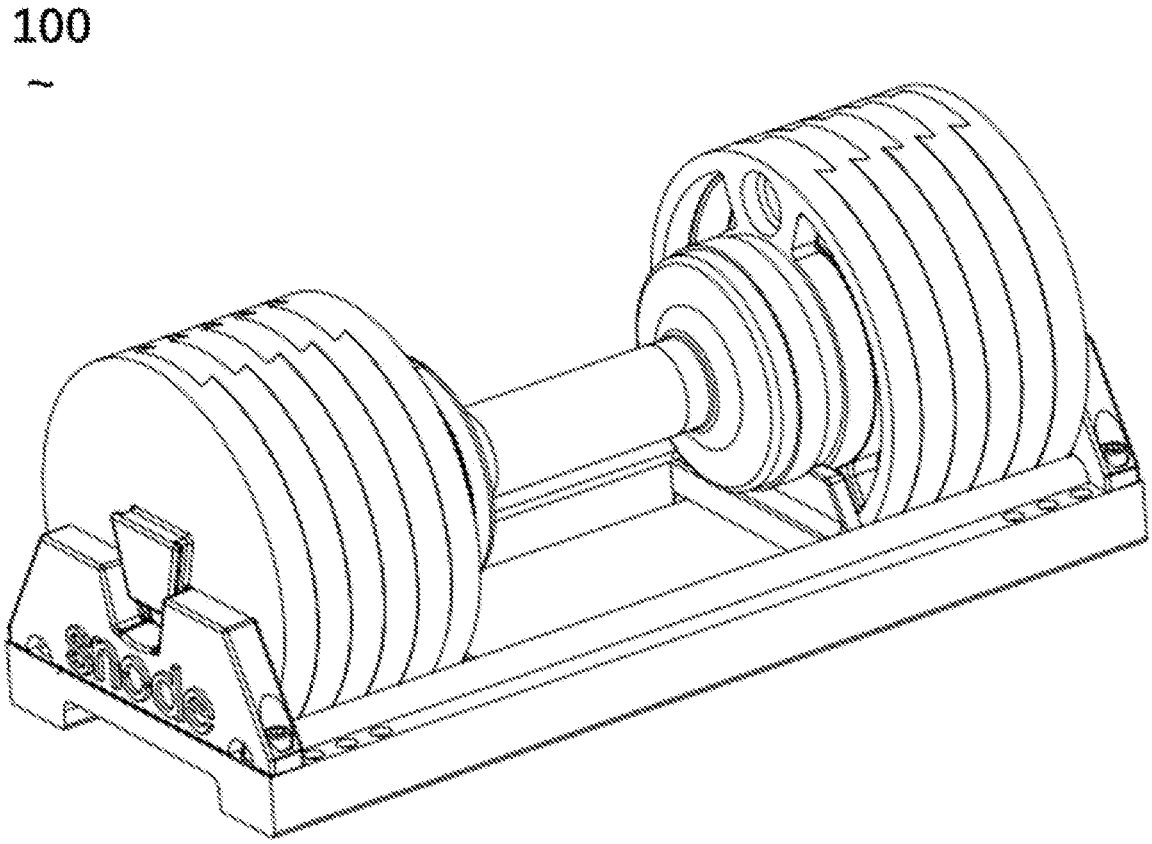
FIG. 1 is a perspective view of a rotary dumbbell according to the present disclosure.
Figure 2:
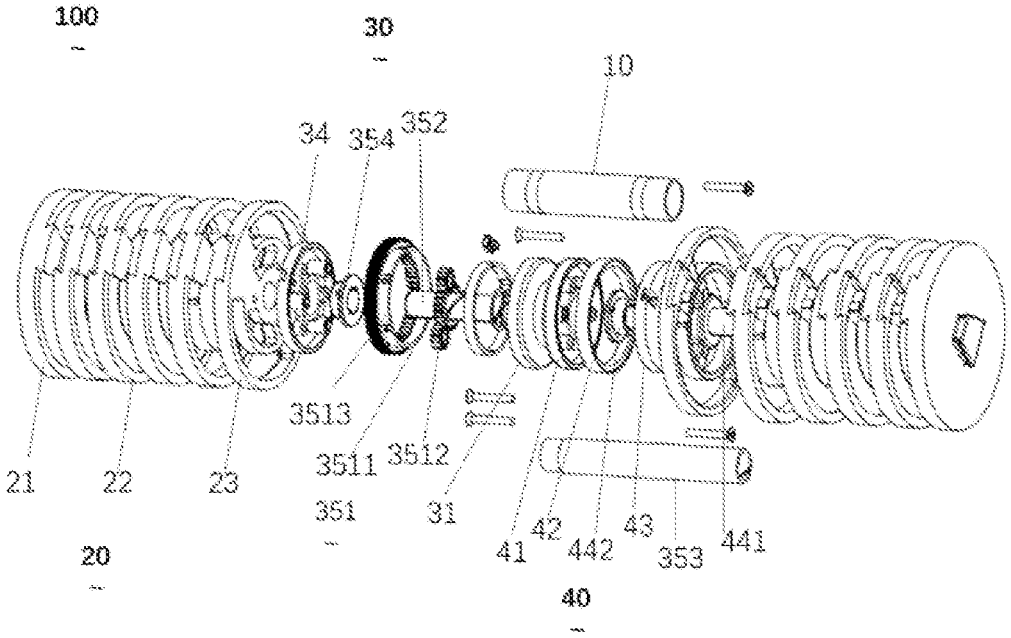
FIG. 2 is an exploded perspective view of FIG. 1.

Referring to FIG. 1 and FIG. 2, the present disclosure provides a rotary dumbbell 100, including a handle part 10, weight parts 20 arranged at two ends of the handle part 10 respectively, and a base part 50.

The rotary dumbbell further includes a transmission self-locking mechanism 30 and a driven mechanism 40 which are arranged at the two ends of the handle part 10 respectively and abut against the two weight parts 20 respectively.

Figure 3:
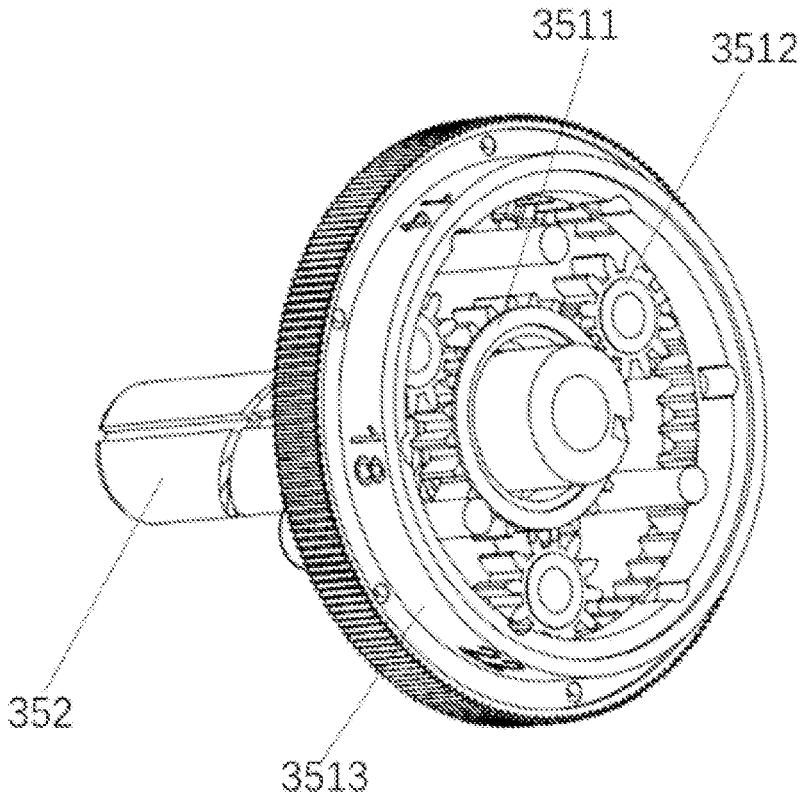
FIG. 3 is a schematic diagram of a structure of a transmission assembly for the rotary dumbbell according to the present disclosure.
Figure 4:
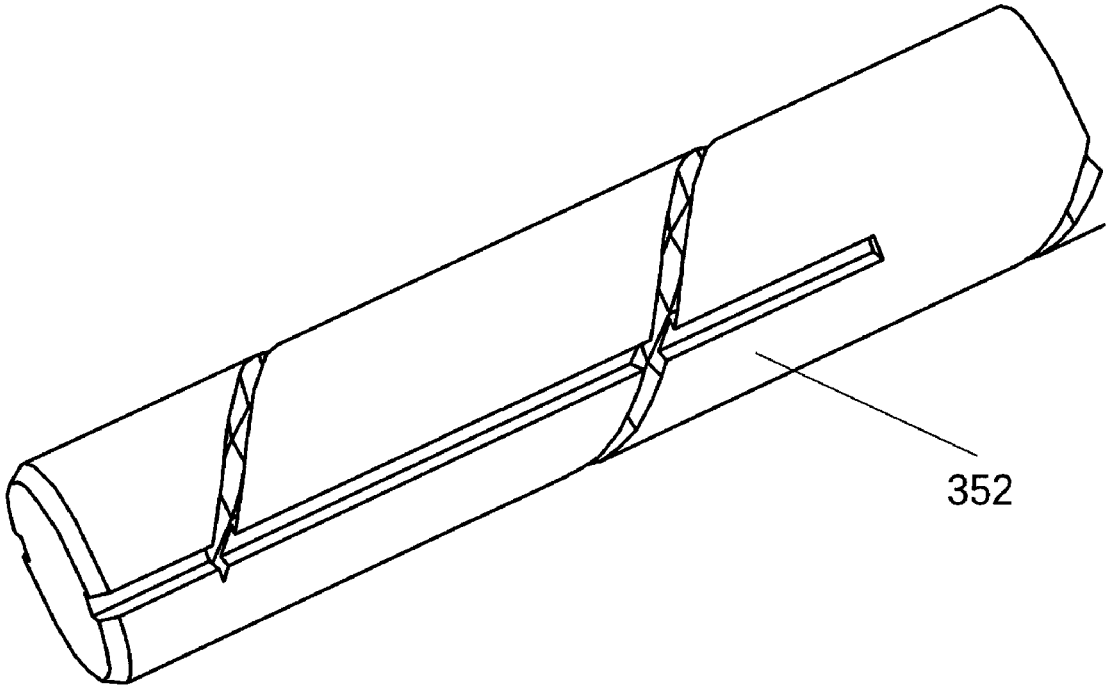
FIG. 4 is a schematic diagram of a structure of a first output screw for the rotary dumbbell according to the present disclosure.
Figure 5:
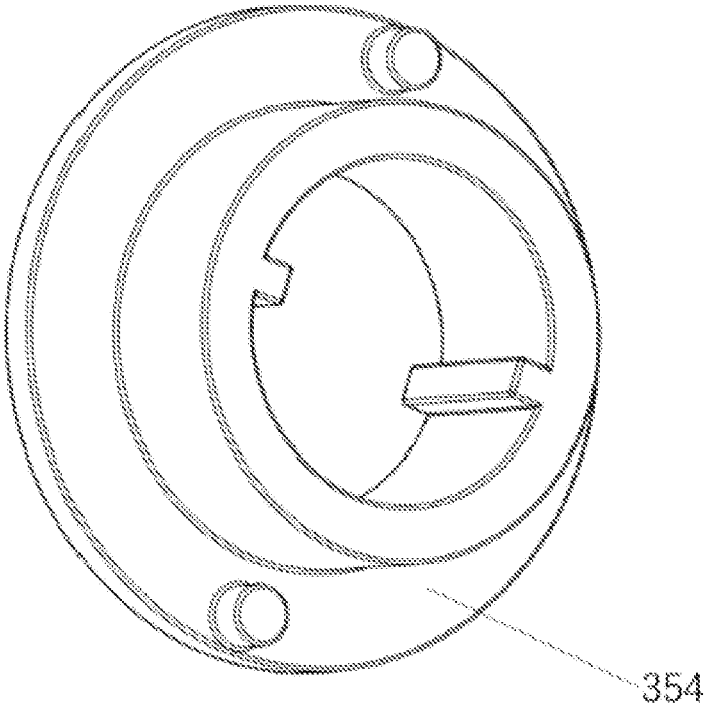
FIG. 5 is a schematic diagram of a structure of a first screw spline for the rotary dumbbell according to the present disclosure.

Referring to FIG. 3, the transmission self-locking mechanism 30 includes a transmission assembly 35; the transmission assembly 35 includes a planetary gear transmission mechanism 351, a first output screw 352 (as shown in FIG. 4), a long nut 353 in matched connection with the first output screw 352, a first screw spline 354 splined to the first output screw 352 (as shown in FIG. 5); the long nut (353) is rotatably connected to the planetary gear transmission mechanism (351), and the long nut 353 is sleeved in the handle part 10.

Referring to FIG. 4 and FIG. 5, as a further optimization of the solution, two grooves are formed on the first output screw 352, and two inner convex strips arranged on the grooves and the screw spline 354 match each other. The screw spline 354 can further be used for positioning a first weight plate 21.

As a further optimization of the solution, an external thread is formed outside the first output screw 352, an internal thread matching the external thread is formed inside the long nut 353, and the first output screw 352 is in threaded connection with the long nut 353.

The planetary gear transmission mechanism 351 includes a sun gear 3511 and a plurality of planetary gears 3512 symmetrically arranged outside the sun gear 3511; a large internal gear 3513 is arranged outside the planetary gears 3512; the large internal gear 3513 is meshed with the planetary gears 3512, and one end of the long nut 353 is sleeved at a middle position of the sun gear 3512.

The long nut 353 is a gear shaft matched with a central through hole of the sun gear 3512, and is rotatably connected to the sun gear 3512.

The weight parts 20 are sleeved on the first output screw 352. Specifically, through holes are formed in the middle of weight plates for one of the weight parts 20, and the first output screw 352 passes through the through holes to sleeve on the weight part 20.

The rotary dumbbell is designed with a transmission mechanism with a star gear adjustment structure, so that a function of automatically adding and removing weight plates in a rotary mode can be achieved. Compared with traditional dumbbells, convenience of using the dumbbell is significantly improved. The function of adding and removing the weight plates can be achieved by rotating and adjusting a gear without disassembling the weight plates during use. Specific operation is as follows:

the large internal gear 3513 is adjusted and rotated to drive the planetary gears 3512 to drive the long nut 353 (gear shaft) which is sleeved with the sun gear 3511 to rotate; then the first output screw 352 in matched connection with the long nut 352 is driven by the long nut 353 to make axial linear movement through the first screw spline 354, so as to achieve extension and retraction of the first output screw 352 in a through hole of the weight part 20 sleeved on the first output screw. That is, the first output screw 352 moves to a side opposite to the handle part 10 when adjusted in a positive direction, so that the first output screw is pulled out from through holes of a plurality of weight plates for the weight parts 20 to detach the first output screw 352 from the through holes to achieve a function of automatically removing weight plates.

The first output screw 352 moves to a side of the weight part 20 sleeved on the first output screw when adjusted in an opposite direction, so that the first output screw is sleeved in through holes of a plurality of weight plates (not sleeved yet) added for the weight part 20 to achieve a function of automatically adding weight plates. Therefore, the rotary dumbbell is designed with an output screw propulsion structure to achieve a function of automatically adding and removing weight plates in a rotary mode.

As a further optimization of the solution, in the present disclosure, a weight scale is arranged on an outer peripheral wall of the large internal gear 3513, and a function of visualizing weight increase and decrease is achieved by rotating the large internal gear 3513.

The transmission self-locking mechanism 30 further includes a self-locking ring 32; the self-locking ring 32 is provided with a self-locking hole 321, a self-locking pin 322 matched with the self-locking hole and a plurality of self-locking posts 323 in matched connection with central through holes of the planetary gears 3512; and the self-locking ring 32 is nested on the large internal gear 3513.

According to the rotary dumbbell, a self-locking structure is further designed on the basis of structural design of the planetary gear transmission mechanism. Through cooperation and control of the self-locking ring 32 and the self-locking pin 322, when the rotary dumbbell 100 is placed on the base part 50, an unlocking thimble 55 on the base part 50 pushes up the self-locking pin 3322 to achieve an unlocking function, then the large internal gear 3513 is rotated, and the self-locking posts 323 for the self-locking ring 32 rotate under the drive of the planetary gear 3512 to adjust weight increase and decrease of the weight plates. When the dumbbell leaves the base part 50, the self-locking pin 33 is pushed out and reset by a spring, and the self-locking ring 32 cannot rotate, and thus the planetary gears 3512 in matched connection with the self-locking posts 323 cannot rotate, so that the transmission mechanism is locked to achieve a self-locking function. In this case, the large internal gear 3513 is locked and cannot rotate, so as to play a protective role and ensure safety.

The transmission self-locking mechanism 30 further includes a first handle flange 31 arranged between the transmission assembly 35 and the handle part 10 and a first transition flange 34 arranged between the transmission assembly 35 and the weight parts 20.

The driven mechanism 40 includes a decorative ring 42, a second handle flange 41 and a second transition flange 43 arranged at two ends of the decorative ring 42 respectively, and a driven assembly 44.

The driven assembly 44 includes a second output screw 441 and a second screw spline 442 splined to the second output screw 441; and the second output screw 441 is in matched connection with the long nut 353.

The weight parts 20 are sleeved on the first output screw 352 and the second output screw 441 respectively.

The working principle of the driven mechanism 40 is as follows: the large internal gear 3513 is adjusted and rotated to drive the planetary gears 3512 to drive the long nut 353 which is sleeved with the sun gear 3511 to rotate; the second output screw 441 is driven by the long nut 353 to make linear movement through a second screw spline 442, so as to achieve extension and retraction of the second output screw 441 in a through hole of the other weight part 20 sleeved on the second output screw, thereby achieving a function of automatically adding and removing weight plates in a rotary mode.

Figure 6:
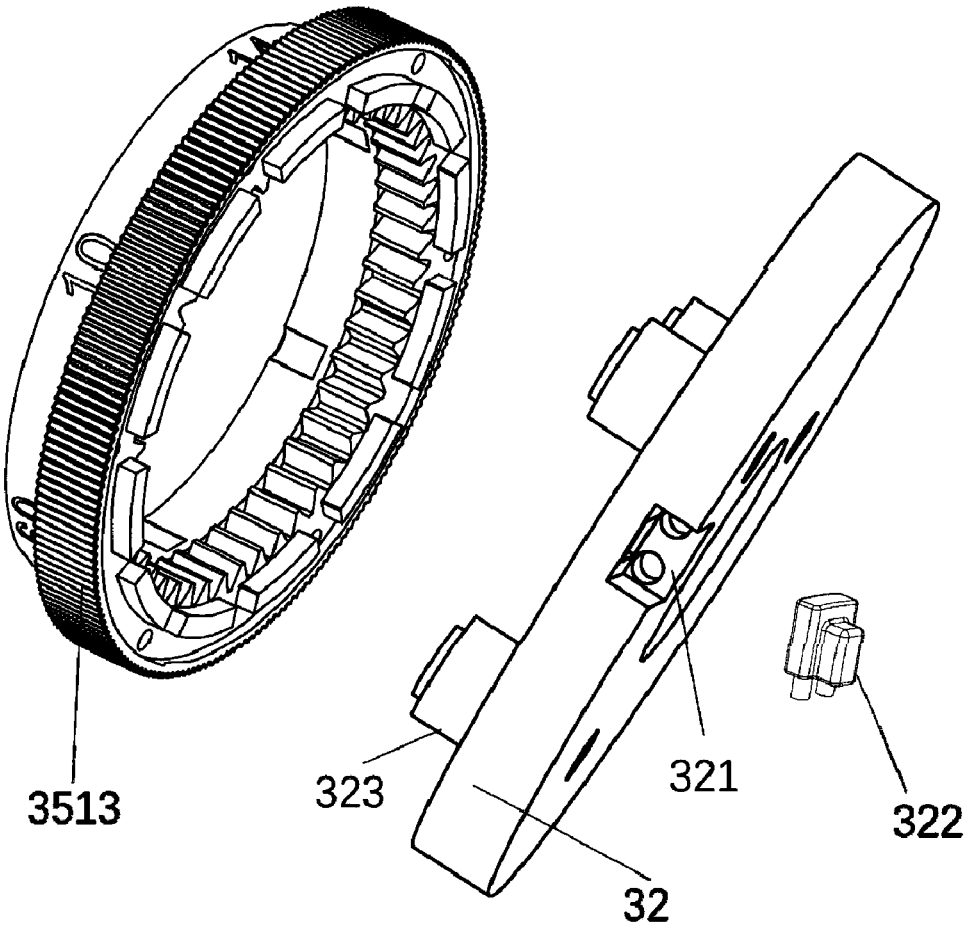
FIG. 6 is a schematic diagram of structures of a self-locking ring and a large internal gear for the rotary dumbbell according to the present disclosure.
Figure 7:
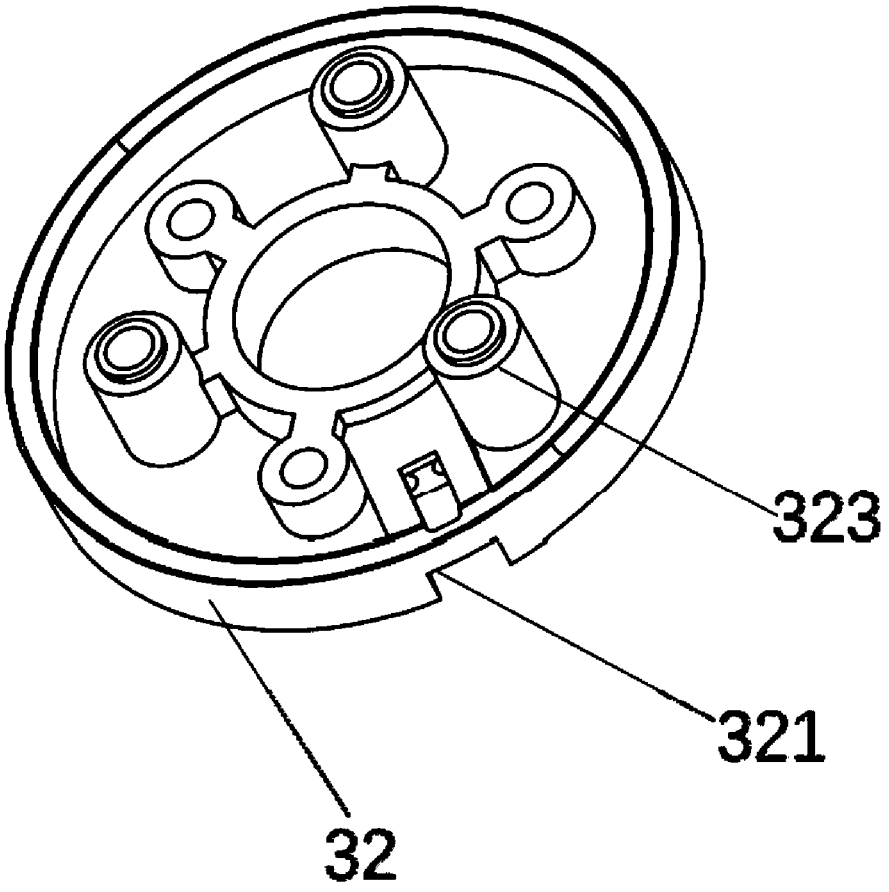
FIG. 7 is a schematic diagram of a structure of a self-locking ring for the rotary dumbbell according to the present disclosure.

Referring to FIG. 6 and FIG. 7, the weight parts 20 include a first weight plate 21, a plurality of middle weight plates 22 and a last weight plate 23 each; a first dovetail groove 24 and a first embedded part 25 are arranged oppositely at one end of the first weight plate 21 and the last weight plate 23, and two ends of the middle weight plates 22 are provided with a second dovetail groove 26 and a second embedded part 27 opposite to each other.

The second dovetail groove 26 is matched with the first embedded part 25, the first dovetail groove 24 is matched with the second embedded part 27, and the second dovetail groove 26 is matched with the second embedded part 27 to achieve quick slide assembly and quick slide disassembly between the first weight plate 21, the plurality of middle weight plates 22 and the last weight plate 23.

In the rotary dumbbell, a dovetail groove structure is designed for connection between weight plates, therefore, the weight plates are intact without notch, and eccentricity is not produced during exercise, so that experience is better, there is no feeling of weightlessness when doing an arc movement, and the weight plates do not make a sound because of swaying from side to side and collision. In addition, the dovetail groove structure can also function as a hook, so that the weight plates are integrated with the hook, and compared with a traditional design that a dumbbell is separated from a hook, the integrated design provided in the present disclosure has advantages of long service life and no potential safety hazard of falling off.

The weight plates are directly locked on the handle without transition component between the dumbbell handle and the weight plates, so that the dumbbell is safer to use.

Figure 8:
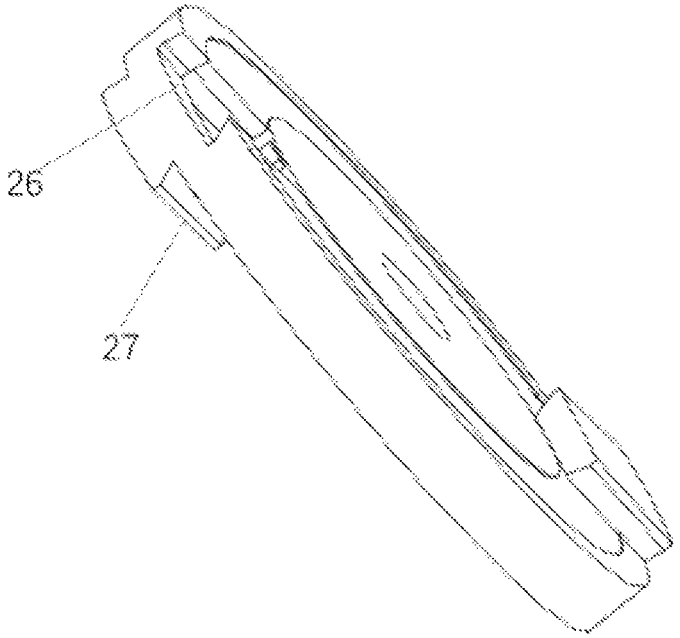
FIG. 8 is a schematic diagram of a structure of middle weight plates for the rotary dumbbell according to the present disclosure.
Figure 9:
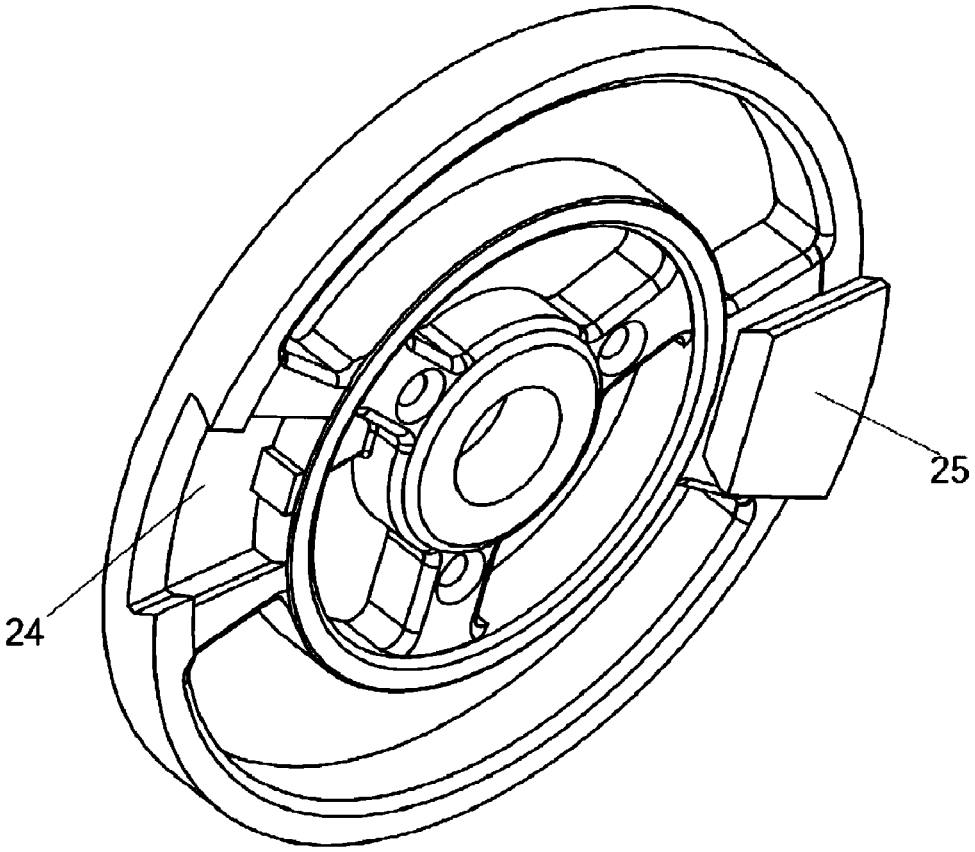
FIG. 9 is a schematic diagram of a structure of a first weight plate for the rotary dumbbell according to the present disclosure.
Figure 10:
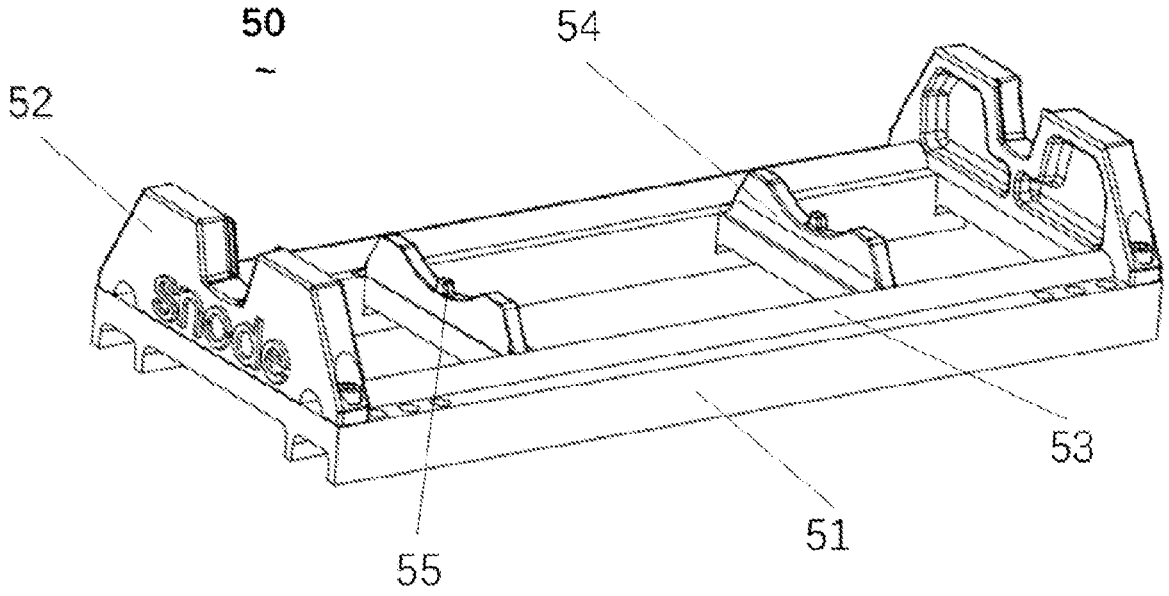
FIG. 10 is a schematic diagram of a structure of a base part for the rotary dumbbell according to the present disclosure.

Referring to FIG. 8, the base part 50 includes a base 51, baffles 52 arranged at two ends of the base 51 respectively, a reinforcing member 53 arranged in a length direction of the base 51, and an arc support seat 54 arranged in the middle of the base 51, and an unlocking thimble 55 opposite to the self-locking pin 33 is arranged on the support seat 54.

The reinforcing member 53 is arranged in a length direction of the base 51, and is made of a stainless steel.

The base part 50 is configured to prevent the weight parts 20 from moving axially and allow the weight plates in the weight parts 20 to move radially corresponding to the base part 50.

According to the rotary dumbbell provided in the present disclosure, functions of automatic weight adjustment in a rotary mode and safe self-locking without manual touch are achieved through propulsion of output screws of the planetary gear transmission mechanism, cooperation between a self-locking device and an unlocking thimble on the base, and design of weight plates with a dovetail groove structure.

According to the rotary dumbbell, a transmission self-locking mechanism, a driven mechanism and weight plates with a dovetail groove structure cooperate with each other to automatically add and remove weight plates in a rotary mode. The working principle is as follows: the large internal gear 3513 is adjusted and rotated to drive the planetary gears 3512 to drive the long nut 353 (gear shaft) which is sleeved with the sun gear 3511 to rotate; then the first output screw 352 and the second output screw 441 that are in matched connection with the long nut 352 are driven by the long nut 353 to make linear movement through the first screw spline 354 and the second screw spline 442, so as to achieve extension and retraction of the first output screw 352 and the second output screw 441 in through holes of the weight parts 20 sleeved on the first output screw and the second output screw. The weight plates are added and removed radially based on the design of the dovetail groove structure through two states, that is, the first output screw 352 and the second output screw 441 are sleeved in and detached from through holes of weight plates for the weight parts 20, so as to achieve a function of automatically adding weight plates.

In conclusion, the present disclosure provides a rotary dumbbell. The rotary dumbbell includes a handle part, a base part, weight parts arranged at two ends of the handle part respectively, and a transmission self-locking mechanism and a driven mechanism which are arranged at the two ends of the handle part respectively and abut against the weight parts respectively. The transmission self-locking mechanism includes a transmission assembly and a self-locking ring; the transmission assembly includes a planetary gear transmission mechanism, a first output screw, a long nut and a first screw spline. The driven mechanism includes a decorative ring, a second handle flange, a second transition flange and a driven assembly. The driven assembly includes a second output screw and a second screw spline; the weight parts are provided with weight plates with a dovetail groove structure; and the base part is provided with an unlocking thimble. According to the dumbbell, weight plates can be automatically added and removed in a rotary mode, and a self-locking device and weight plates with a dovetail groove structure are designed, so that the dumbbell is convenient, rapid and safe to use, and provides excellent user experience.

Finally, it should be noted that the embodiments above are only intended to illustrate rather than to limit the technical solutions of the present disclosure; although the present disclosure has been described in detail with reference to the foregoing embodiments, it should be understood by those of ordinary skill in the art that the technical solutions described in the foregoing embodiments can be modified, or equivalent replacements can be made to some or all of the technical features therein; and these modifications or replacements do not separate the essence of the corresponding technical solutions from the technical solutions of the embodiments of the present disclosure.

The invention claimed is:

1. A rotary dumbbell, comprising a handle part (10) and weight parts (20) arranged at two ends of the handle part (10) respectively, and further comprising a transmission self-locking mechanism (30) and a driven mechanism (40) which are arranged at the two ends of the handle part (10) respectively and abut against the two weight parts (20) respectively; wherein the transmission self-locking mechanism (30) comprises a transmission assembly (35); the transmission assembly (35) comprises a planetary gear transmission mechanism (351), a first output screw (352), a long nut (353) in matched connection with the first output screw (352), and a first screw spline (354) splined to the first output screw (352); the long nut (353) is rotatably connected to the planetary gear transmission mechanism (351) to enable the long nut (353) to rotate under the drive of the planetary gear transmission mechanism (351), so that the first output screw (352) moves axially through the first screw spline (354).

2. The rotary dumbbell according to claim 1, wherein the planetary gear transmission mechanism (351) comprises a sun gear (3511) and a plurality of planetary gears (3512) symmetrically arranged outside the sun gear (3511); a large internal gear (3513) is arranged outside the planetary gears (3512); the large internal gear (3513) is meshed with the planetary gears (3512), and the long nut (353) is sleeved at a middle position of the sun gear (3511).

3. The rotary dumbbell according to claim 2, wherein the transmission self-locking mechanism (30) further comprises a self-locking ring (32); the self-locking ring (32) is provided with a self-locking hole (321), a self-locking pin (322) matched with the self-locking hole and a plurality of self-locking posts (323) in matched connection with central through holes of the planetary gears (3512); and the self-locking ring (32) is nested on the large internal gear (3513).

4. The rotary dumbbell according to claim 1, wherein the transmission self-locking mechanism (30) further comprises a first handle flange (31) arranged between the transmission assembly (35) and the handle part (10) and a first transition flange (34) arranged between the transmission assembly (35) and the weight parts (20).

5. The rotary dumbbell according to claim 1, wherein the driven mechanism (40) comprises a decorative ring (42), a second handle flange (41) and a second transition flange (43) which are arranged at two ends of the decorative ring (42) respectively, and a driven assembly (44).

6. The rotary dumbbell according to claim 5, wherein the driven assembly (44) comprises a second output screw (441) and a second screw spline (442) splined to the second output screw (441); the second output screw (441) is in matched connection with the long nut (353); and the weight parts (20) are sleeved on the first output screw (352) and the second output screw (441) respectively.

7. The rotary dumbbell according to claim 1, wherein the weight parts (20) comprise a first weight plate (21), a plurality of middle weight plates (22) and a last weight plate (23) each; a first dovetail groove (24) and a first embedded part (25) are arranged oppositely at one end of the first weight plate (21) and the last weight plate (23), and two sides of the middle weight plates (22) are provided with a second dovetail groove (26) and a second embedded part (27) opposite to each other; and positions of the second dovetail groove (26) and the second embedded part (27) on the two sides are corresponding to each other.

8. The rotary dumbbell according to claim 3, wherein the rotary dumbbell further comprises a base part (50), the base part (50) comprises a base (51), baffles (52) arranged at two ends of the base (51) respectively, a reinforcing member (53) arranged on the base (51), a support seat (54) arranged in the middle of the base (51), and an unlocking thimble (55) opposite to the self-locking pin (322) is arranged on the support seat (54).

9. The rotary dumbbell according to claim 7, wherein the second dovetail groove (26) is matched with the first embedded part (25), the first dovetail groove (24) is matched with the second embedded part (27), and the second dovetail groove (26) is matched with the second embedded part (27) to achieve quick slide assembly and quick slide disassembly between the first weight plate (21), the plurality of middle weight plates (22) and the last weight plate (23).

10. The rotary dumbbell according to claim 8, wherein the reinforcing member (53) is arranged in a length direction of the base (51), and is made of a stainless steel.

* * * * *